US005309059A

United States Patent [19]

Kume et al.

[11] Patent Number: 5,309,059

[45] Date of Patent: May 3, 1994

[54] COLOR CATHODE RAY TUBE

[75] Inventors: Hisao Kume; Mitsuhiro Kawase, both of Tokyo, Japan

[73] Assignee: Sony Corporation, Tokyo, Japan

[21] Appl. No.: 828,934

[22] PCT Filed: Jun. 4, 1991

[86] PCT No.: PCT/JP91/00746

§ 371 Date: Feb. 5, 1992

§ 102(e) Date: Feb. 5, 1992

[30] Foreign Application Priority Data

Jun. 5, 1990 [JP] Japan ..... 2-147031
Nov. 30, 1990 [JP] Japan ..... 2-338353

[51] Int. Cl.[5] ..... H01J 29/07
[52] U.S. Cl. ..... 313/402; 313/403
[58] Field of Search ..... 313/402, 403, 407, 408, 313/477 R

[56] References Cited

U.S. PATENT DOCUMENTS 4,692,660 9/1987 Adler et al. ..... 313/477 R
4,926,089 5/1990 Moore ..... 313/403
4,942,332 7/1990 Adler et al. ..... 313/402
5,041,756 8/1991 Fairbanks ..... 313/402

FOREIGN PATENT DOCUMENTS 58-214252 12/1983 Japan .
62-206739 9/1987 Japan .
63-231836 9/1988 Japan .
2210298A 7/1989 United Kingdom .

*Primary Examiner*—Donald J. Yusko
*Assistant Examiner*—Nimesh Patel
*Attorney, Agent, or Firm*—Hill, Steadman & Simpson

[57] ABSTRACT

A color cathode ray tube in which an aperture grill is provided having a large number of slits extended in the extending direction of fluorescent stripes bored through the grill in parallel. The slits are provided in an opposing relation to a color fluorescent screen in which the fluorescent stripes of respective colors are arranged in a predetermined order in parallel. The aperture grill is composed of a thin plate having the slits. This a frame on which the thin plate is extended with a predetermined tension in the extending direction of the slits and this thin plate is formed of a high purity iron thin plate having a thickness of equal to or less than 0.05 mm. Since the thickness of the thin plate is selected as described above, controllability of the width of the slit in the manufacturing process can be improved. Therefore, the accuracy of the aperture grill can be increased, the productivity thereof can be increased, the weight thereof can be reduced, and further, the color cathode ray tube can be formed as a high definition color cathode ray tube.

6 Claims, 5 Drawing Sheets

COLOR CATHODE RAY TUBE

TECHNICAL FIELD

This invention generally relates to color cathode ray tubes for use in a wide variety of display devices such as TV and so on, and, more particularly, to a color cathode ray tube of a Trinitron (registered trademark) type.

BACKGROUND ART

In a color cathode ray tube, a color selecting mechanism is provided in opposing relation to a color fluorescent screen to thereby cause an electron beam to land on predetermined fluorescent patterns.

In an ordinary color cathode ray tube, a shadow mask in which a single circular beam aperture, for example, is bored through a metal plate for a dot-shaped red, green and blue fluorescent triplet, for example, is provided in opposing relation to the color fluorescent screen as a color selecting mechanism. Such a shadow mask is supported to a frame by welding a circumferential portion of the metal plate molded as a dome shape by a press-treatment or the like. In this case, the shadow mask is supported to the frame without the application of tension so that, when a temperature of the shadow mask rises due to the electron beam scanned thereon, a so-called doming phenomenon which gives rise to a color misregistration is caused by the thermal expansion. To solve this problem, an Invar material having a low coefficient of thermal expansion is utilized as a mask material and the plate thickness thereof tends to increase in order to increase strength.

On the other hand, in the color cathode ray tube of the Trinitron type, three electron beams corresponding to red, green and blue colors are arranged on the horizontal plane and a color fluorescent screen is formed by arranging red, green and blue fluorescent stripes, each extending in the vertical direction, in a predetermined order in parallel. Also, an aperture grill, in which a large number of slits extended along the extending direction of the fluorescent stripes are formed, is disposed in an opposing relation to the fluorescent stripes as a color selecting mechanism.

In the ordinary aperture grill, as shown in FIG. 6 which is a schematic perspective view of an example of the ordinary aperture grill, a large number of slits 4 are bored through a metal plate 42 formed of a high purity iron thin plate having a thickness of 0.08 to 0.15 mm. This metal plate 42 is stretched over a frame 3. The frame 3 composed of a pair of opposing frame side members 3A, 3B an members 3C, 3D disposed across these frame side members 3A, 3B. The front end faces of the frame side members 3A, 3B are formed as curved surfaces forming the same cylindrical surface, and the metal plate 42 is stretched over these frame side members 3A and 3B.

When this metal plate 42 is stretched over and attached to the frame 3, the frame side members 3A and 3B of the frame 3 are drawn closer to each other by a turnbuckle. Then, under this condition, the metal plate 42 is secured at its edge portions corresponding to the respective ends of each slit 4 to the front end faces of the frame side members 3A and 3B by the welding-process. Thereafter, the external force applied to the frame 3 is released, whereby the band-shaped portions between the slits 4 on the metal plate 42 are extended in the extending direction of the slit 4 with a predetermined tension by a restitution force.

On the other hand, since the color cathode ray tube has recently become larger in size, the length of the band-shaped portion between the slits 4 of the metal plate 42 of the aperture grill 10 is increased so that, when an electron beam strikes the fluorescent screen, the band-shaped portion tends to vibrate due to vibration caused by sound, impulses or the like, which gives rise to problems such as occurrence of color misregistration or the like. Therefore, in order to suppress the vibration of the band-shaped portion, the thickness of the metal plate 42 is increased to increase rigidity, or the thickness of the material forming the frame 3 is increased to increase a resilient force which removes the above-mentioned distortion, thereby suppressing the vibration of the band-shaped portion.

The slits 4 are formed on the relatively thick metal plate 42 by etching both surfaces 42A and 42B of the metal plate 42 according to the photolithography technique. That is, as shown in FIG. 7A, a photoresist is coated on one surface 42A of the metal plate 42, is subjected to the pattern exposure, is developed, and is removed by the photolithography technique to form a predetermined stripe pattern through which openings 42AC are opened, an etching mask 11A being thus formed. Then, in a like manner, an etching mask 11B having openings 42BC, whose opening width is made large as compared with the width of the openings 42AC, is formed on the rear surface 42B in opposing relation to the pattern of the former etching mask 11A. Then, as shown in FIG. 7B, the first etching process is carried out, in which stripe-shaped grooves are formed on the two surfaces 42A and 42B by the etching process which uses an etchant such as $FeCl_3$ (ferric chloride) or the like.

Then, as shown in FIG. 7C, a protecting film 12 such as a varnish or the like is coated on the stripe-shaped groove on the surface 42A side, and is used as an etching mask to carry out for the other surface 42B a relatively gentle etching with an etchant such as $FeCl_3$ having a relatively low concentration until the protecting film 12 is exposed, as shown in FIG. 7D.

Thereafter, by removing the protecting film 12, the slit 4, whose cross section is substantially in an "8" letter shape, is formed as shown in FIG. 8. When the etching is carried out twice and the slit 4 is formed by the second etching whose etching rate is slow as compared with the case when the groove is formed by one etching-process, the etching time can be controlled with ease in reliable fashion so that an excess proceeding or the etching can be prevented. As a consequence, each etching depth can be formed with accuracy and therefore an effective width of the slit 4, i.e., a distance SW between the edges 7 produced by the etching process of the two surfaces, can be formed with excellent controllability and with high accuracy, even when the metal plate 42 is thick. However, this technique cannot avoid the problem that a workability is deteriorated as compared with the case where the groove is formed by one etching process.

When the edge 7 is formed as described above, a tapered portion 8 of a gentle curved shape is formed from the respective surfaces 42A, 42B to the edge 7. Accordingly, as shown in FIG. 9 which is a cross-sectional view illustrating that electron beams impinge upon a color fluorescent screen 5 when this aperture grill 10 is used, an incident electron beam Ei becomes incident on the color fluorescent screen 5 through the slit 4 to make the fluorescent dots of stripe shapes luminous. On the other hand, a reflected electron beam $Er_1$ from the color fluorescent screen 5 due to the secondary emission is reflected on the surface of the aperture grill 10 and on the tapered portion 8 to cause scattered electron beams Es or a reflected electron beam $Er_2$ to occur. As a result, the light emission of the color fluorescent screen 5 becomes inaccurate, which gives rise to the deterioration of color contrast and color purity. Further, when the slits 4 of the aperture grill 10 are formed through the thick metal plate 42 by one etching process, the surface area of the tapered portion 8 is increased more, which makes the problem of the deterioration of the color contrast and color purity more remarkable.

As described above, in the conventional color cathode ray tube of the Trinitron type, it is preferable that the aperture grill thereof uses the relatively thick metal plate 42. In this case, however, since the weight of the aperture grill 10 is increased because the resilient force must be increased in order to suppress the vibration as earlier noted, there is the problem that the total weight of the color cathode ray tube is unavoidably increased.

Furthermore, the width SW of the slit 4 which can be formed in the above-mentioned etching process is about 50% of a thickness t of the metal plate 42 due to the restrictions from an etching characteristic standpoint. For this reason, if the thickness of the metal plate 42 is increased, the width SW of the slit 4 is increased in proportion to the thickness t of the metal plate. There is then the problem that the slits cannot be densified, that is, the color cathode ray tube cannot be formed as a high definition color cathode ray tube.

SUMMARY OF THE INVENTION

The present invention is directed to a color cathode ray tube in which an aperture grill having a large number of slits extended in the extending direction of parallel fluorescent stripes in is disposed in an opposing relation to a color fluorescent screen on which fluorescent stripes of respective colors are arranged in a predetermined order in parallel. The aperture grill is constructed such that the above-mentioned slits are formed through a high purity iron thin plate having a thickness of equal to or less than 0.05 mm, and that this thin plate is stretched on a frame in the extending direction of the slits with a predetermined tension.

In the present invention, contrary to an accomplished idea concerning the thickness of the metal plate forming the existing aperture grill, the thickness of the metal plate of the aperture grill is selected to be equal to or less than 0.05 mm. Even when the thickness of the metal plate is reduced as described above, the vibration of the band-shaped portions of the aperture grill caused by the sound and impulses can be suppressed similarly to the prior art. The reason for this will be understood as follows.

Assuming that the band-shaped portion of the aperture grill is a string, then the resonance frequency f thereof is given by the following equation (11):

$$f=(gT/\rho)^{\frac{1}{2}}/2l \qquad (11)$$

where g is the gravitational acceleration, $\rho$ the linear density of the string, T the stress and l the length of the string. Accordingly, in the prior art, while the length l of the string is increased as the color cathode ray tube becomes larger, the value of the resonance frequency f is increased by increasing the stress T to avoid the frequency band of the principal vibration such as sound or the like, the vibration being thus controlled. According to the present invention, when the thickness of the aperture grill is reduced, then the linear density of the string, that is, $\rho$, is decreased and accordingly, the resonance frequency f is increased and therefore can be deviated from the principal resonance frequency band relating to the frequency such as sound, vibration or the like. Thus, even when the thickness of the metal plate is reduced as described above, then the vibration of the band-shaped portion in the aperture grill can be suppressed, similarly to the prior art. Therefore, the occurrence of color misregistration or the like caused by the vibration such as sound, impulses or the like when electron beams strike the fluorescent screen can be avoided, which can improve the image quality of the color cathode ray tube.

As shown in FIG. 4 which is a cross-sectional view of an aperture grill thin plate 1, the thickness of the aperture grill thin plate is thin so that slits 4 can be formed with high accuracy, even by one etching process. Also, productivity can be improved by the reduction of the etching time, and yield can be improved by the reduction of the material.

Further, since the width of the slit, which can be formed in the etching process, is about 0.5 t relative to the thickness t of the metal plate through which the slit is formed, the thickness t is reduced and therefore the width of the slit can be reduced as compared with the prior art. Thus, the accuracy of the aperture grill can be increased, which can densify the slits, that is, which can provide a high definition color cathode ray tube.

Furthermore, the surface area of a tapered portion is reduced in accordance with the reduction of the thickness so that, as shown in FIG. 5 which is a schematic cross-sectional view of impingement of electron beams, reflection and scattering of electron beams at the tapered portion 8 can be suppressed. Thus, the deterioration of the color contrast and color purity can be suppressed, which can provide a color cathode ray tube of high definition.

Also, since the thickness of the aperture grill thin plate is reduced, rigidity of the frame member can be reduced and the aperture grill can be reduced in weight. In addition, in accordance with the reduction of the weight, a power required by a degauss coil which degausses an external magnetism in the color cathode ray tube can be reduced, which can improve characteristics such as low power consumption or the like.

DESCRIPTION OF THE PREFERRED EMBODIMENTS

Figure 1:
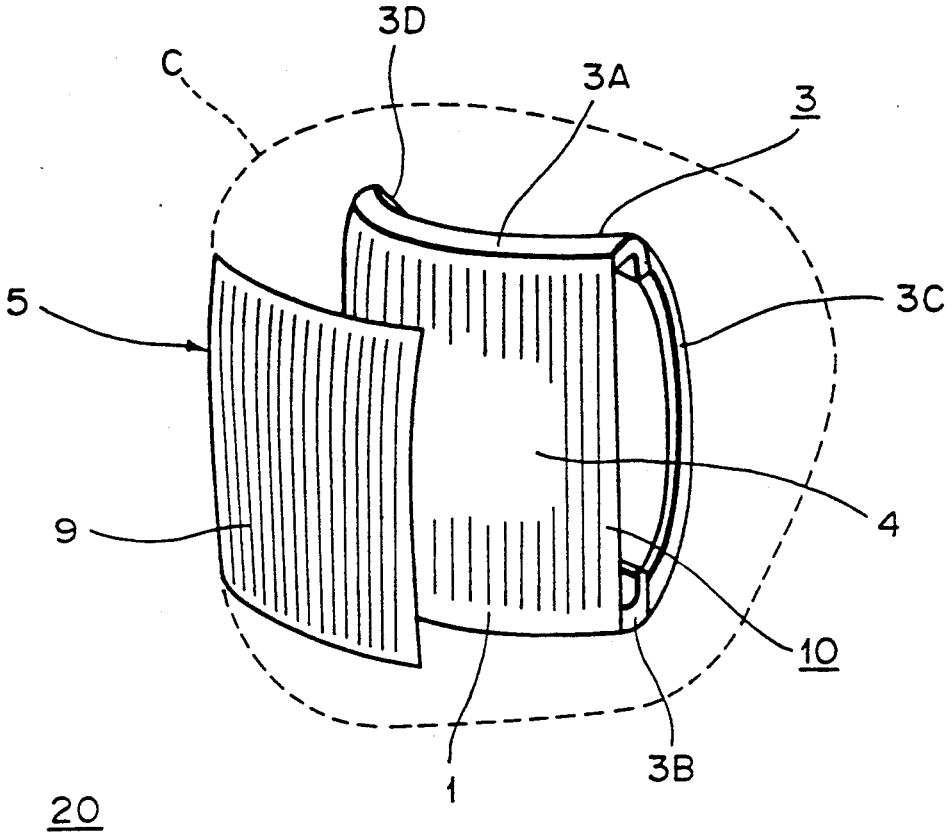
FIG. 1 is a schematic perspective view illustrating a preferred embodiment of a color cathode ray tube according to the present invention.

In a color cathode ray tube according to the present invention, as shown in FIG. 1 which shows an example thereof, an aperture grill 10 having a number of slits 4 extended in the extending direction of fluorescent stripes 9 and bored therethrough in parallel, is disposed in an opposing relation to a color fluorescent screen 5 on which the fluorescent stripes of respective colors are arranged in a predetermined order in parallel.

This aperture grill 10 is constructed in such a manner that a large number of slits 4 are bored through an aperture grill thin plate 1 having a thickness of equal to or less than 0.05 mm, for example, a 0.05 mm-thick thin plate made of iron of high purity, and this aperture grill thin plate 1 is stretched over a frame 3. The frame 3 is comprised of a pair of opposing frame side members 3A, 3B and arm members 3C, 3D extended between these frame side members 3A and 3B. The front end faces of the frame side members 3A, 3B are formed as curved surfaces forming the same cylindrical surface, and the aperture grill thin plate 1 is stretched over these frame side members 3A and 3B.

When this aperture grill thin plate 1 is stretched on the frame 3, the frame side members 3A and 3B of the frame 3 are drawn closer to each other by a turnbuckle. Then, under this condition, the aperture grill thin plate 1 is secured at its edge portions corresponding to the respective ends of each slit 4 to the front end faces of the frame side members 3A and 3B by the welding-process. Thereafter, the external force applied to the frame 3 is released, whereby the band-shaped portions between the slits 4 of the aperture grill thin plate 1 are extended in the extending direction of the slits 4 with a predetermined tension by a restitution force of the frame 3.

Respective examples of methods of forming the slits 4 of the aperture grill thin plate 1 are represented in process diagrams of FIGS. 2A and 2B and FIGS. 3A and 3B.

Figure 2A:
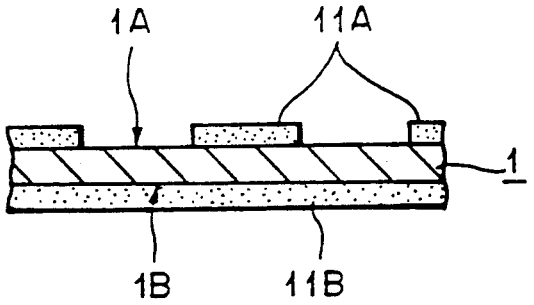
FIGS 2A, 2B and FIGS. 3A, 3B are manufacturing process diagrams showing a method of producing an aperture grill of the color cathode ray tube according to the present invention.
Figure 2B:
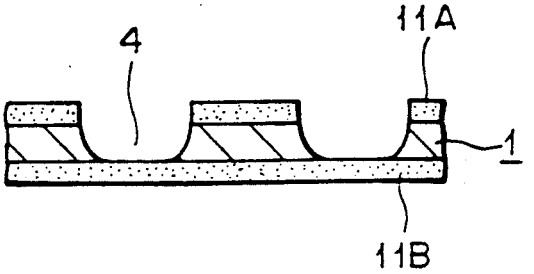

Initially, as shown in FIG. 2A, on one surface 1A of the thin plate 1 formed of a high purity iron thin plate having a thickness of, for example, 0.05 mm, an etching mask 11A is formed so as to have a predetermined stripe-shaped pattern, that is, so as to be extended in the direction perpendicular to the drawing sheet of FIG. 2 by the photolithography technique such as the coating of photoresist, the pattern exposure, the development or the like. Further, a photoresist or the like is coated on the whole surface of the other surface 1B to form an etching mask 11B. Then, as shown in FIG. 2B, the etching process is carried out from the surface IA side by using an etchant such as $FeCl_3$ or the like, the stripe-shaped slits 4 being thus formed.

In this case, the thickness of the aperture grill thin plate 1 is as thin as about 0.05 mm so that, even when the etching speed is made relatively low, the slits 4 of a predetermined width can be formed accurately without increasing the etching time considerably, that is, with excellent productivity only by the etching process from one surface 1A side as described above.

Figure 3A:
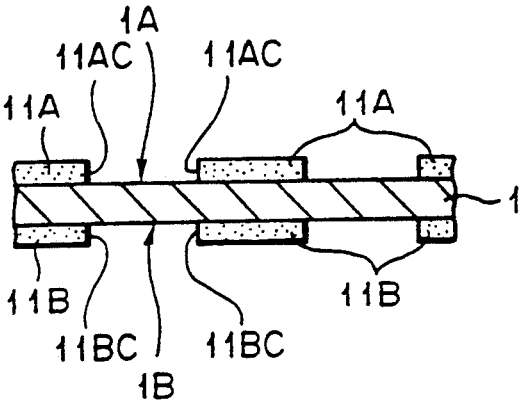
Figure 3B:
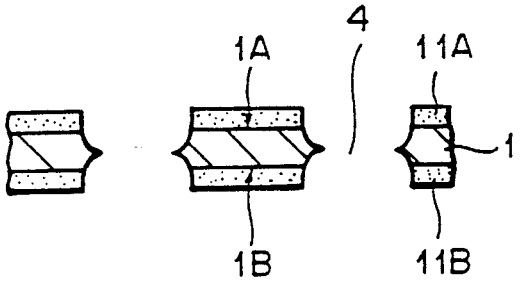

Alternatively, as shown in FIG. 3A, on the two surfaces 1A and 1B of the aperture grill thin plate 1 formed of a high purity iron thin plate having a thickness of about 0.05 mm, by the application of the photolithography technique, there are formed etching masks 11A and 11B of stripe-shaped patterns extending in the direction perpendicular to the sheet of the drawing of, for example, FIG. 3, and in which respective openings 11AC and 11BC are provided in a correct opposing relation, the opening widths thereof being mad substantially equal. Then, these etching masks are used as the masks, and from the two surfaces 1A and 1B, the etching is carried out by using the etchant such as $FeCl_3$ or the like to thereby form the stripe-shaped slit 4 as shown in FIG. 3B.

Also in this case, the thickness of the aperture grill thin plate 1 is selected to be as thin as about 0.05 mm so that, even when the etching rate is decreased relatively, the slit 4 of the predetermined width can be formed with high accuracy and with excellent productivity, similarly to the method shown in FIG. 2.

Figure 4:
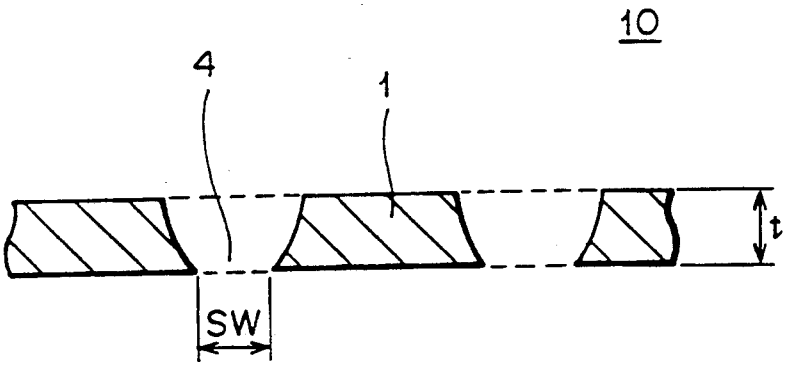
FIG. 4 is a schematic enlarged cross-sectional view illustrating an aperture grill of the color cathode ray tube according to the present invention.

After the slit 4 is formed as described above, the etching masks 11A and 11B are removed and an aperture grill having a predetermined slit width SW can be obtained as shown in FIG. 4.

In this case, since the thickness t of the aperture grill thin plate 1 is 0.05 mm and is sufficiently thin, the width SW of the slit 4, which can be formed by the etching-process, becomes 0.5 t, i.e., 0.025 mm, which can provide the slits 4 more densified as compared with those of the prior art. Therefore, the color cathode ray tube 20 can be formed as the high definition color cathode ray tube.

Figure 5:
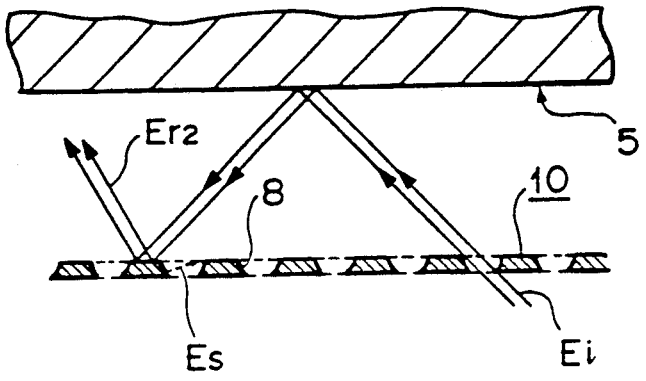
FIG. 5 is a cross-sectional view illustrating the incident condition of electron beams of the color cathode ray tube according to the present invention.
Figure 6:
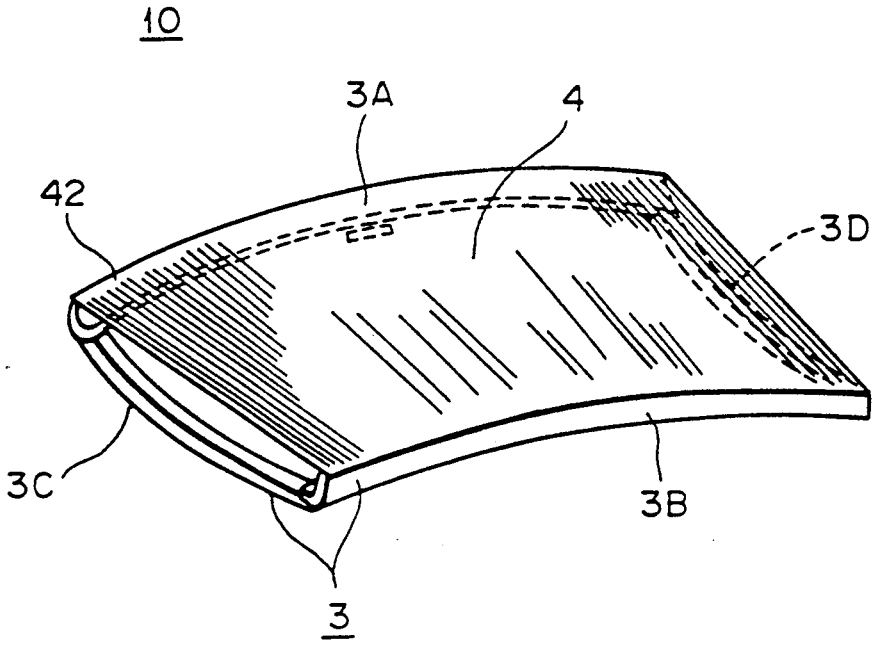
FIG. 6 (PRIOR ART)
FIG. 6 is a perspective view illustrating a conventional aperture grill.
Figure 7A:
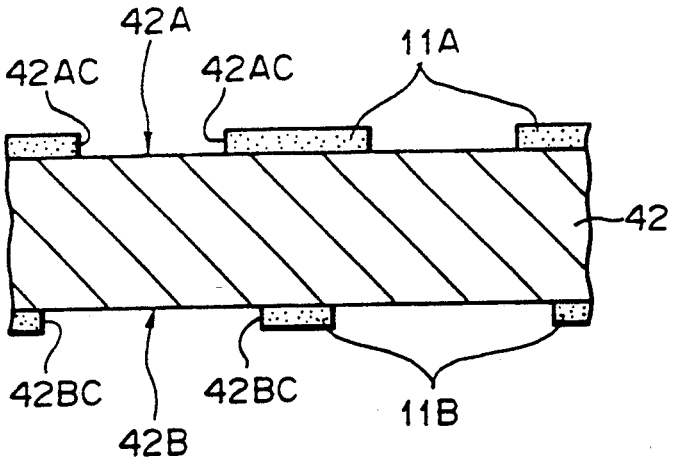
FIG. 7A (PRIOR ART)
FIGS. 7A through 7B are manufacturing process diagrams showing a method of producing the conventional aperture grill.
Figure 7B:
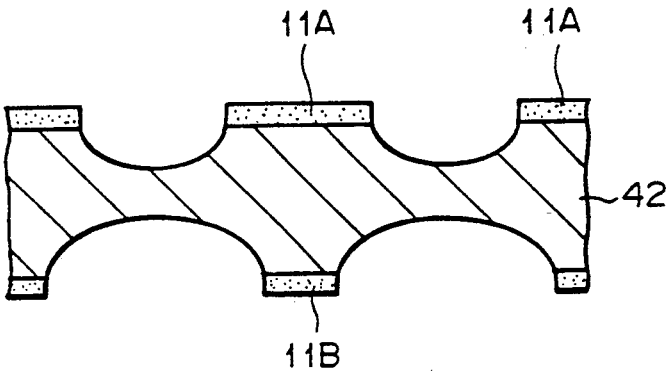
FIG. 7B (PRIOR ART)
Figure 7C:
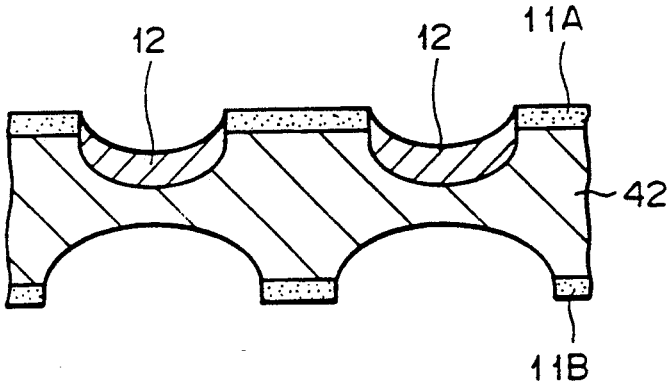
FIG. 7C (PRIOR ART)
Figure 7D:
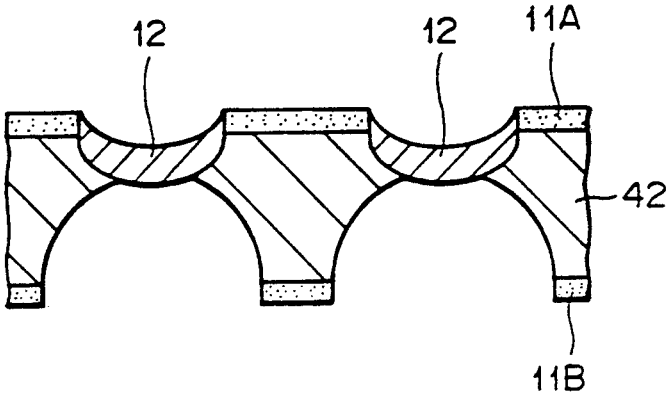
FIG. 7D (PRIOR ART)
Figure 8:
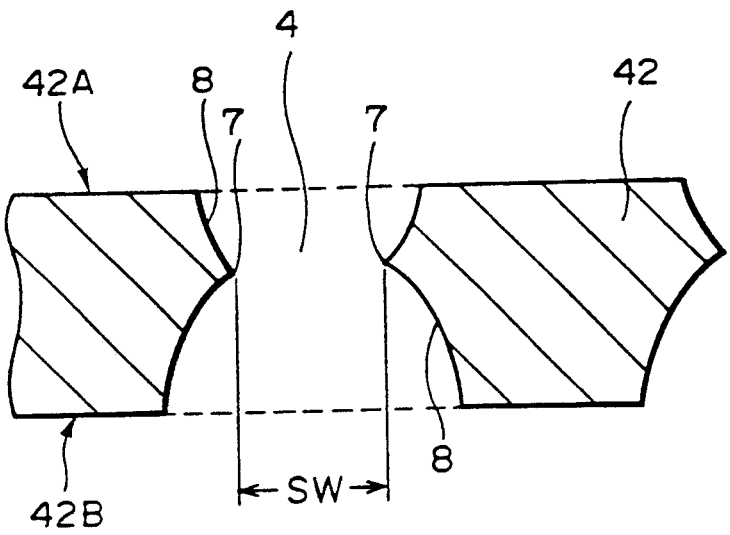
FIG. 8 (PRIOR ART)
FIG. 8 is a schematic enlarged cross-sectional view of the conventional aperture grill.
Figure 9:
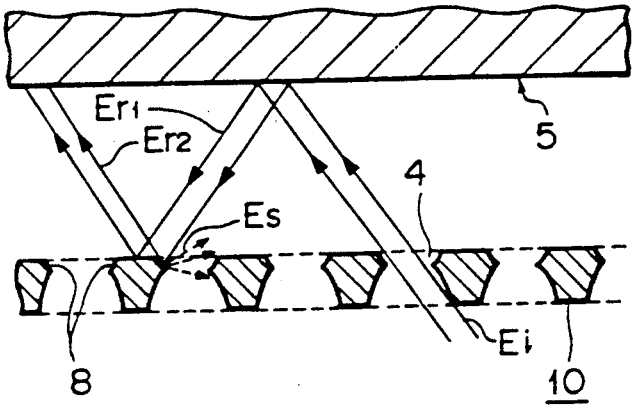
FIG. 9 (PRIOR ART)
FIG. 9 is a cross-sectional view illustrating the incident condition of electron beams of the color cathode ray tube according to the prior art.

As shown in FIG. 5, which shows the condition such that electron beams become incident on the aperture grill 10, since the thickness of the aperture grill thin plate 1 is reduced, the surface area of the tapered portion 8 and the surface area of the aperture grill 10 on its surface opposing the color fluorescent screen 9 side also are reduced. Consequently, it is possible to suppress the occurrence of the scattered electron beam Es and the reflected electron beam Er2, which cause the color contrast and the color purity to be deteriorated in the prior art.

Although various minor changes and modifications might be suggested by those skilled in the art, it will be understood that we wish to include within the scope of the patent warranted hereon all such changes and modifications as reasonably come within our contribution to the art.

We claim:

1. A color cathode ray tube screen and grill assembly comprising:

a color fluorescent screen having a plurality of respective color fluorescent strips arranged in a predetermined order in parallel on the fluorescent screen;

an aperture grill adjacent to and spaced from the screen having a frame including first and second frame side members, and a thin high purity iron plate stretched on the frame, said thin high purity iron plate being connected to and extending between the first and second frame side members at a predetermined tension;

said thin high purity iron plate having band-shaped portions defining a plurality of slits, each of which slits extends continuously without interruption from the first frame side member to the second frame side member, said slits running parallel with the fluorescent stripes; and said thin high purity iron plate having a thickness of equal to or less than 0.05 mm so that a natural resonance frequency of the plate band-shaped portions is in a region which does not respond to sound and impulse vibrations.

2. The assembly according to claim 1 wherein the first and second frame side members are curved.

3. The assembly according to claim 1 wherein the first and second frame side members are connected by flexible arm members which impart said predetermined tension to said thin plate.

4. The assembly according to claim 1 wherein the slits are defined by side walls and wherein each side wall has upper and lower curved portions meeting at a point.

5. The assembly according to claim 1 wherein the thin plate thickness is substantially 0.05 mm.

6. The assembly according to claim 1 wherein the frame side members are curved and the aperture grill is curved about an axis parallel to said slits.

* * * * *